US005466275A

United States Patent [19]

More

[11] Patent Number: 5,466,275

[45] Date of Patent: Nov. 14, 1995

[54] METHOD AND APPARATUS FOR DESULPHURIZING IRON WITH MINIMAL SLAG FORMATION

[76] Inventor: Anton More, Marienbergstrasse 48c, D-84489 Burghausen, Germany

[21] Appl. No.: 295,733

[22] PCT Filed: Feb. 25, 1993

[86] PCT No.: PCT/DE93/00165

§ 371 Date: Aug. 29, 1994

§ 102(e) Date: Aug. 29, 1994

[87] PCT Pub. No.: WO93/17131

PCT Pub. Date: Sep. 2, 1993

[30] Foreign Application Priority Data

Feb. 27, 1992 [DE] Germany ..... 42 06 091.5

[51] Int. Cl.[6] ..... C21C 1/02

[52] U.S. Cl. ..... 75/10.46; 75/10.47

[58] Field of Search ..... 75/10.47, 10.46

[56] References Cited

U.S. PATENT DOCUMENTS

| | | | |
|---|---|---|---|
| 3,802,865 | 4/1974 | Ohkubo | 75/10.47 |
| 4,534,791 | 8/1985 | More | 75/10.47 |

FOREIGN PATENT DOCUMENTS

| | | |
|---|---|---|
| 2246615 | 3/1974 | Germany . |
| 51-059714 | 5/1976 | Japan . |
| 54-114415 | 6/1979 | Japan . |

OTHER PUBLICATIONS

Metals, vol. 2 #20, Jan. 1968, p. 51.

*Primary Examiner*—Peter D. Rosenberg
*Attorney, Agent, or Firm*—O'Connor, Cavanagh

[57] ABSTRACT

The invention relates to a method and apparatus for desulphurizing iron with minimal slag formation, comprising the steps of melting and heating, to a temperature of about 1400° to 1800° C., a slag having the following chemical composition:

20% max $SIO_2$;

30% max/$Al_2O_3$;

about 5–40% $SiO_2$+$Al_2O_3$+$TiO_2$ combined;

2% max FeO;

1.5% max MnO;

about 25–65% CaO+MgO+BaO+$Na_2O$+$K_2O$;

20% max MgO;

10% max $Na_2O$+$K_2O$;

60% max $CaF_2$;

about 50–85% CaO+MgO+BaO+$Na_2O$+$K_2O$+$CaF_2$;

percentages by weight; where the ratio of the percentage by weight of CaO plus MgO divided by the percentage by weight of $SiO_2$ plus one-half $Al_2O_3$ is at least two and where the ratio of the percentage by weight of $Na_2O$ plus $K_2O$ to $SiO_2$ is no more than one; then mixing the sulphur-containing hot metal with this bath of molten slag so as not to exceed 10 parts molten iron per part slag by weight. The desulphurized molten iron is then drawn from beneath the slag bath. The process may be accomplished using a low shaft furnace according to the present invention comprising a furnace body lined with carbon bricks or carbonaceous, basic or high-alumina refractory bricks and having a discharge pipe extending down to the bottom of the furnace chamber for discharging the desulphurized molten iron from beneath the slag bath.

12 Claims, 2 Drawing Sheets

FIG. 2

*Stated in % by weight*

| Example No. | Sample No. | SLAG | | | | | | | | | | | IRON | |
|---|---|---|---|---|---|---|---|---|---|---|---|---|---|---|
| | | $SiO_2$ | $Al_2O_3$ | $TiO_2$ | FeO | MnO | CaO | MgO | $CaF_2$ | S Found | Nominal S Calculated | ΔS Calculated | S | ΔS Found |
| 1 | 0 | | | | | | | | | | | | 0.210 | |
| | 1 | | | | | | | | | 5.93 | — | — | 0.017 | −0.193 |
| | 2 | 13.52 | 17.21 | <0.10 | <0.10 | <0.10 | 45.10 | 4.63 | 16.16 | 5.65 | 6.03 | −0.38 | 0.013 | −0.197 |
| | 3 | | | | | | | | | 5.37 | 5.75 | −0.38 | 0.010 | −0.200 |
| | 4 | | | | 1.32 | 2.23 | | | | 0.08 | | | | |
| | 5 | | | | 0.29 | 0.16 | | | | 0.12 | | | | |
| 2 | 0 | | | | | | | | | | | | 0.210 | |
| | 1 | | | | | | | | | 6.47 | — | — | 0.008 | −0.202 |
| | 2 | | | | | | | | | 6.26 | 6.57 | −0.31 | 0.001 | −0.209 |
| | 3 | 12.87 | 15.27 | <0.10 | 0.12 | <0.10 | 52.53 | 2.55 | 12.65 | 6.03 | 6.36 | −0.33 | 0.001 | −0.209 |
| | 4 | | | | | | | | | 5.54 | 6.13 | −0.59 | 0.001 | −0.209 |
| | 5 | | | | | | | | | 0.13 | | | | |
| 3 | 0 | | | | | | | | | | | | 0.210 | |
| | 1 | 15.61 | 21.22 | 0.07 | 0.08 | <0.10 | 52.21 | 4.28 | 5.58 | 7.08 | — | | 0.003 | −0.207 |
| | 2 | | | | | | | | | 6.62 | 7.18 | −0.56 | 0.002 | −0.208 |
| | 3 | | | | | | | | | 6.23 | 6.72 | −0.49 | 0.002 | −0.208 |
| 4 | 0 | | | | | | | | | | | | 0.210 | |
| | 1 | | | | | | | | | 8.32 | — | | 0.044 | −0.166 |
| | 2 | 6.10 | 0.50 | <0.10 | 0.028 | 0.30 | 20.95 | 0.60 | 67.10 | 8.10 | 8.40 | −0.30 | 0.059 | −0.151 |
| | 3 | | | | | | | | | 7.95 | 8.18 | −0.23 | 0.046 | −0.164 |
| | 4 | | | | | | | | | 7.76 | 8.03 | −0.27 | 0.053 | −0.157 |

METHOD AND APPARATUS FOR DESULPHURIZING IRON WITH MINIMAL SLAG FORMATION

CROSS-REFERENCE TO RELATED APPLICATION

This application corresponds to German Patent No. P 42 06 091.5 filed Feb. 27, 1992 and claims priority to that date under the Patent Cooperation Treaty and Paris Convention.

BACKGROUND OF THE INVENTION

The present invention relates to a method and apparatus for desulphurizing iron with minimal slag formation. Molten pig iron coming out of the blast furnace usually contains about 0.03% to 0.08% sulphur. Depending on the purpose of the final product, the sulphur content of the molten pig iron or "hot metal" is usually reduced to a range of from 0.01% to 0.005% by various desulphurization methods before further processing in the steelworks.

Prior art methods of desulphurizing pig iron include the use of carbide-containing desulphurizing agents or, to an increasing extent, mixtures containing metallic magnesium. Soda desulphurization is also common. Iron desulphurization according to these methods forms large amounts of sulphur-containing slags also containing about 50% iron. A large blast furnace producing 10,000 tons of pig iron per day produces about 300 tons of this waste, iron-containing desulphurization slag. Recovery of the iron from this slag is labor-consuming and expensive.

Disposal of large amounts of this waste slag is also a serious problem. Because the slags contain sulphur-compounds, they emit toxic and ill-smelling hydrogen sulfide gas when exposed to water. Moreover, these waste slags can also contain unreacted carbide, which releases toxic and explosive acetylene gas when exposed to water. A primary solution has been use of very expensive, wet-chemical techniques for processing these slags, such as that disclosed in German Patent DE 3837249 A1.

A further problem with prior art desulphurization techniques is that, in addition to producing large amounts of slag, these processes utilize an immersion lance to inject the desulphurization mixtures in the torpedo or the charging ladle. Injection of the desulphurization mixture causes a considerable temperature drop in the hot metal, which if not carefully controlled, may cause large amounts of pig iron to solidify causing considerable financial loss.

Accordingly, a principal object of the present invention is to provide an iron desulphurizing method and apparatus that produces little or no sulphur-containing slag to be processed or disposed, and which does not require precise control to avoid causing the molten iron to solidify.

Another significant object of the present invention is to provide an iron desulphurizing method that docs not require expensive desulphurizing agents such as carbide or magnesium.

SUMMARY OF THE INVENTION

According to the present invention, desulphurization is accomplished by melting and heating, to a temperature of about 1400° to 1800° C., a slag having the following chemical composition:

20% max $SIO_2$;

30% max $Al_2O_3$;

about 5–40% $SiO_2+Al_2O_3+TiO_2$ combined;

2% max FeO;

1.5% max MnO;

about 25–65% $CaO+MgO+BaO+Na_2O+K_2O$;

20% max MgO;

10% max $Na_2O+K_2O$;

60% max $CaF_2$;

about 50–85% $CaO+MgO+BaO+Na_2O+K_2O+CaF_2$;

percentages by weight; and where the ratio of the percentage by weight of CaO plus MgO divided by the percentage by weight of $SiO_2$ plus one-half the total percentage by weight of $Al_2O_3$ is at least two—i.e.

$$\frac{CaO + MgO}{SiO_2 + {}^1/_2Al_2O_3} \geqq 2$$

and where the ratio of the percentage by weight of $Na_2O$ plus $K_2O$ to $SiO_2$ is no more than one—i.e.

$$\frac{Na_2O + K_2O}{SiO_2} \leqq 1$$

plus other trace impurities. The sulphur-containing hot metal is desulphurized by mixing it with this bath of molten slag and allowing the purified molten iron to be drawn from underneath. The process may be accomplished using a low shaft furnace according to the present invention comprising a furnace body lined with carbon bricks or carbonaceous, basic or high-alumina refractory bricks and having a discharge pipe extending down to the bottom of the furnace chamber for discharging the purified molten iron.

BRIEF DESCRIPTION OF THE DRAWINGS

The above and other objects, aspects, features and attendant advantages of the present invention will become apparent from a consideration of the ensuing detailed description of presently preferred embodiments and methods thereof, taken in conjunction with the accompanying drawings, in which:

FIG. 2 is a table of experimental results.

DESCRIPTION OF PREFERRED EMBODIMENTS AND METHODS

Figure 1:
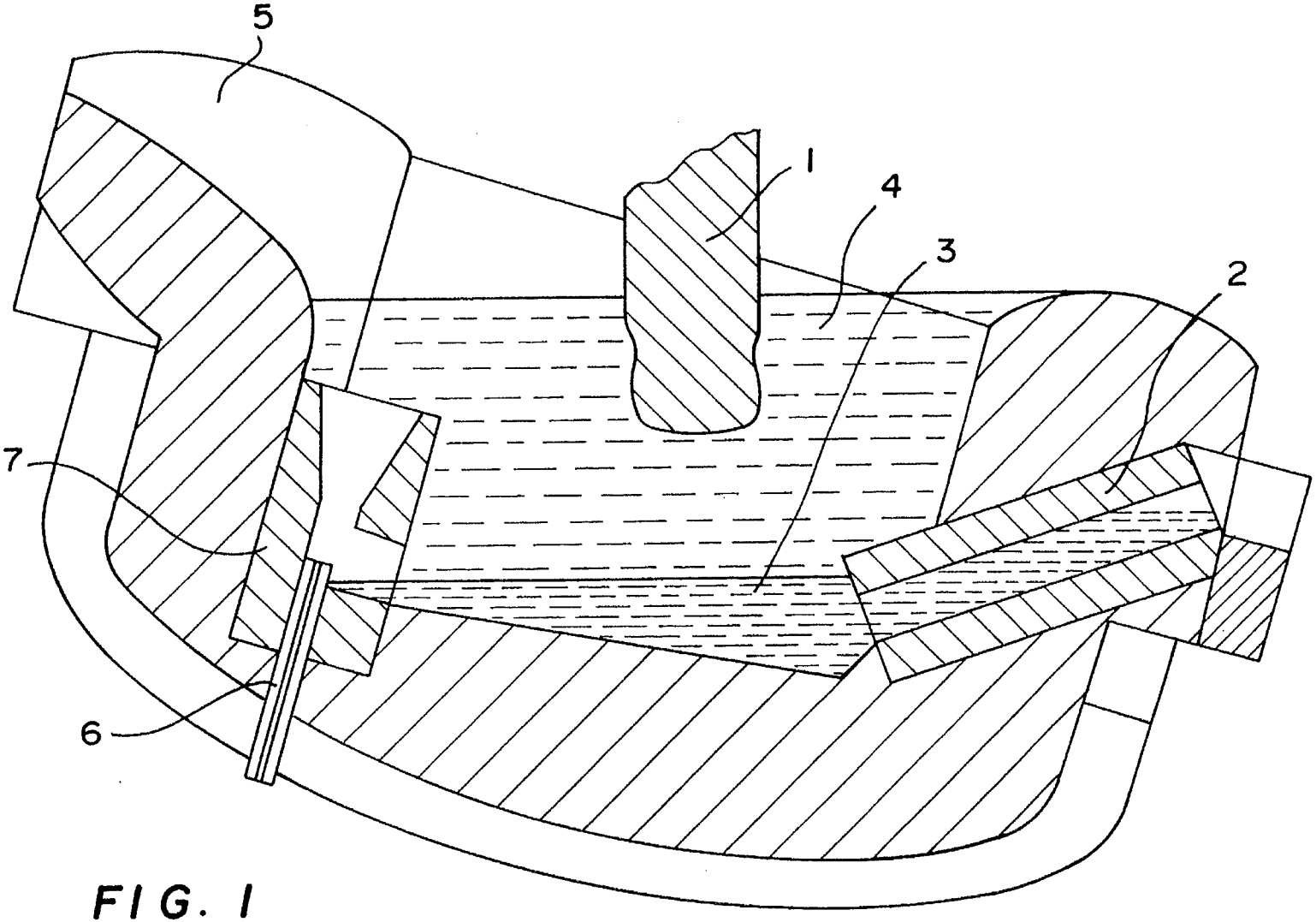
FIG. 1 is an cross section of a low shaft furnace according to the present invention.

FIG. 1 shows a preferred embodiment of a low-shaft furnace according to the present invention. The low-shaft furnace is heated electrically by means of graphite electrodes 1. It is tiltable and has discharge pipe 2 which extends down to the bottom of the furnace chamber. The discharge pipe permits the desulphurized molten iron 3 to be removed from beneath the molten desulphurization slag 4. Opposite the discharge pipe there is feed trough 5 for introduction of the hot metal to be desulphurized. One or more tuyeres 6 is provided at the bottom of the furnace tank, below the feed trough for the molten hot metal. For improved mixing of the molten hot metal and desulphurization slag, hopper 7 is provided under the feed trough 5, but above the bottom tuyere 6. Preferably, the low-shaft furnace is lined with carbon or, particularly on the furnace bottom and wherever predominantly molten iron comes in contact with the lining, carbonaceous, basic or high-alumina refractory lining.

The slag is melted initially by igniting an arc between the electrodes to melt a small amount of slag. As soon as a slag bath is present the electrodes are immersed in the molten slag and resistance heating continues until the remaining slag is melted. The molten slag is then heated to a temperature of 1400° to 1800° C., preferably 1500° to 1700° C., and most preferably 1550° to 1650° C.

The sulphur-containing molten hot metal is then fed into this hot slag, whereupon rapid desulphurization of the hot metal occurs. The desulphurizing reaction can be accelerated if a gas comprising argon, nitrogen or air or mixtures of these gases is injected, for example, through a porous plug or one or more bottom tuyeres, so that hot slag is forced up toward the inflowing hot metal. Introduction of gas through a tuyere also agitates the purified molten iron that settles to the bottom of the furnace, thereby causing it to release whatever sulphur remains.

The reaction can be further accelerated if the a hopper 7 is provided above one or more tuyeres. The hopper permits the incoming sulphur-containing hot metal to be vigorously mixed with the desulphurization slag forced up from below.

Gases such as air and/or water vapor can also be blown into the molten slag using one or more lances immersed in the molten slag from above to accelerate the desulphurization process.

To accelerate the desulphurizing reaction even further one can also blow the customary desulphurizing agents, e.g. based on carbide or lime, with the gas through the bottom tuyere. Such a measure may be appropriate when, for example, one must desulphurize iron with a particularly high sulphur content and/or to an extremely low final content in a very short time.

Once the process has started, the furnace is tilted to allow the desulphurized molten iron to pour from the discharge pipe. Desulphurization occurs at such a rapid pace that the process can be carried out continuously with hot metal added to and desulphurized iron continuously discharged from the furnace.

Other melting units can also be used for the present invention, provided that it is possible to melt slag by means of electrodes therein and to discharge the iron separately from the slag either continuously or intermittently. Such melting units include ladle furnaces or electric furnaces with eccentric bottom tapping.

If a ladle furnace is used the ladle is first filled with high-sulphur iron, then an amount of slag is melted on the iron with the aid of electrodes. The molten iron is stirred by injection of gases through one or more porous plugs on the bottom of the ladle while the slag is being melted. After the slag is melted, air or air and water or water vapor is blown into the molten slag by means of one or more water-cooled lances immersed in the slag until the desired sulphur content of the molten iron is reached. The desulphurized iron is then discharged by a slide gate located on the bottom of the ladle. Fresh high-sulphur iron is then put in the ladle and desulphurization of the next batch is begun.

Because, according to the present invention the desulphurized molten iron is withdrawn from the bottom of the furnace, the awkward, time-consuming deslagging process is eliminated. In the prior art, deslagging must be carried out after iron desulphurization, because about 5% of the original high-sulphur slag still remains on the desulphurized iron, which would otherwise resulphurize the steel during subsequent processing.

The chemical analysis of the slag according to the present invention is as follows:

$SIO_2 \leqq 20\%$ by weight;

$Al_2O_3 \leqq 30\%$ by weight;

$SiO_2+Al_2O_3+TiO_2=5\%-40\%$ by weight;

$FeO \leqq 2.0\%$ by weight $MnO \leqq 1.5\%$ by weight $CaO+MgO+BaO+Na_2O+K_2O=25\%-65\%$ by weight $MgO \leqq 20\%$ by weight $Na_2O+K_2O \leqq 10\%$ by weight $CaF_2 \leqq 60\%$ by weight $CaO+MgO+BaO+Na_2O+K_2O+CaF_2=50\%-85\%$ by weight $$\frac{CaO + MgO}{SiO_2 + 0.5Al_2O_3} \geqq 2$$

$$\frac{Na_2O + K_2O}{SiO_2} \leqq 1$$

plus trace impurities.

The preferred composition of the slag has the following chemical analysis:

$SIO_2 \leqq 15\%$ by weight $Al_2O_3 \leqq 30\%$ by weight $SiO_2+Al_2O_3+TiO_2=20\%-40\%$ by weight $FeO \leqq 1.2\%$ by weight $MnO=0.7\%$ by weight $CaO+MgO=30\%-65\%$ by weight $MgO \leqq 15\%$ by weight $CaF_2=2\%-50\%$ by weight $CaO+MgO+CaF_2=55\%-80\%$ by weight $Na_2O+K_2O \leqq 1.0\%$ by weight $$\frac{CaO + MgO}{SiO_2 + 0.5Al_2O_3} \geqq 2$$

plus trace impurities.

The particularly preferred composition of the slag has the following chemical composition:

$SIO_2=5\%-15\%$ by weight $Al_2O_3 \leqq 25\%$ by weight $SiO_2+Al_2O_3+TiO_2=25\%-40\%$ by weight $TiO_2 \leqq 5\%$ by weight $FeO \leqq 0.7\%$ by weight $MnO \leqq 0.5\%$ by weight $CaO+MgO=50\%-65\%$ by weight $MgO \leqq 5\%$ by weight $CaF_2=7\%-30\%$ by weight $CaO+MgO+CaF_2=55\%-75\%$ by weight $Na_2O+K_2O \leqq 0.5\%$ by weight $$\frac{CaO + MgO}{SiO_2 + 0.5Al_2O_3} \geqq 2$$

plus trace impurities

Ideally, the desulphurization process is carried out with the weight of molten iron to slag maintained at a ratio smaller than 10, preferably smaller than 5, and for continuous desulphurization preferably smaller than 2.5.

The slag is usually exhausted when its sulphur content has exceeded about 6 to 8% by weight. A low-shaft furnace containing 5 tons of desulphurization slag can, therefore, desulphurize 750 to 1000 tons of hot metal having an initial sulphur content of 0.05% to a final sulphur content of 0.01%.

However, if fluorine-containing desulphurization slags are used, the process can be carried out without the slag losing any of its desulphurization effect. For example, by blowing air or mixtures of air and water vapor into the slag by means of one or more lances the a sulphur content of the slag is reduced by about 1% per hour. This means that 25 tons of iron based on the weight of the desulphurization slag can be desulphurized from an initial sulphur content of 0.054 by weight to a final content of 0.014 by weight per hour, without the sulphur content in the slag increasing.

This result is surprising for two reasons:

1) Removal of sulphur from a desulphurization slag to this extent apparently has never been described before.
2) The state of the art teaches that a slag with a high sulphur content which is subjected to oxidizing treatment not only loses its ability to desulphurize but, on the contrary, has a resulphurizing effect on iron with a low sulphur content.

According to the present invention, one can—in completely surprising fashion—desulphurize a much greater amount of iron than is possible simply due to the solubility of sulphur in the slag.

If the desulphurization slag becomes saturated with sulphur so that it is no longer able to desulphurize the iron to the degree required, the slag can be subjected to a regeneration process. For this purpose the inflow of hot metal is first stopped and the molten desulphurized iron completely discharged. Regeneration of the slag takes place by oxidation, optionally after addition of $SiO_2$ and/or $Al_2O_3$. The oxidation of the slag can be performed by injecting air and/or oxygen or by adding an oxidizing agent such as iron oxide, iron ore and/or manganese ore. Within a few minutes the sulphur content of the molten slag can be reduced for example from 6% to under 0.204.

A reducing agent (for example coal, coke, lignite coke, peat coke or charcoal) is then fed onto the melt and the oxides from the desulphurization slag reduced by superheating the melt. Other reducing agents such as aluminum can also be used to reduce the heavy metal oxides in the slag. As soon as the heavy metal oxides are reduced (i.e. so-called white slag exists) the desulphurization process for iron can be begun again. The oxidation process does produce $SO_2$, however, this can be converted into gypsum by conventional means, such as by reacting with hydrated lime in an ordinary scrubber processing the waste-gas stream from the furnace.

Small amounts of slag are unavoidably formed because the sulphur-containing molten pig iron cannot be completely separated from entrained blast-furnace slag before the desulphurization process. Accordingly, a certain amount of blast furnace slag is constantly being added to the contents of the low shaft furnace. To hold the chemical analysis of the desulphurization slag constantly at the optimal composition one must therefore add small amounts mainly of lime, fluorspar and possibly alumina to counteract the effects of the blast furnace slag to maintain the appropriate chemical composition of the desulphurization slag.

Because the amount of slag in the low shaft furnace unavoidably increases, some desulphurization slag must be discharged from time to time. The best time for doing this is after the described slag regeneration process, when the slag has little sulphur has maximum desulphurizing power. Such a slag can then be used as a high-quality and cost-effective slag raw material, for example for use in a ladle furnace.

The inventive desulphurization process for iron thus produces no slag to be dumped or subjected to elaborate processing. The present invention is, therefore, very ecologically acceptable. Compared to the prior art, the present invention produces only a fraction of the waste slag, and, as described above, even this can be processed into low-sulphur, high-quality desulphurization slag with the only by-product being small amounts of gypsum that can easily be processed.

The present method may also be carried out on scrap iron, provided the sufficient power is available to melt and desulphurize the scrap iron.

The low-shaft furnace of the present invention also can easily be located at various places in the production line between blast furnace and converter since it requires very little height between the feed trough for the sulphur-containing molten pig iron and the discharge pipe for the desulphurized molten iron.

EXAMPLES

A pilot furnace with an elliptic tank was used that was lined with carbon and had a holding space 400 mm long, 260 mm wide and 240 mm deep. The furnace had on the discharge side a graphite pipe with an outside diameter of 100 mm and an inside diameter of 30 mm which extended down to the bottom of the hearth. In this kettle 20 kg desulphurization slag was melted down with the aid of two electrodes having a diameter of 100 mm.

To achieve a faster result, i.e. to reach the sulphur saturation of the slag as fast as possible, pyrite was added to the slag for sulphurization.

After a slag temperature in the range of 1500° C. to 1650° C. was reached, 10 kg scrap cast iron was added and melting continued with full power, i.e. at 15 V and 750 A.

As soon as all the cast iron was melted, the slag and cast iron were held at their temperature for one half hour. Depending on the experimental variant, slag and melt was either stirred with a graphite rod for five minutes at the end of the half-hour test period (Examples 1 and 4) or air or air plus water vapor was blown into the slag by means of a lance during the half-hour melting time (Examples 2 and 3). The blow-in rate of the gases was selected so that the slag was vigorously stirred but no large amounts of slag splashed out of the pilot furnace.

The desulphurized cast iron was then discharged through the graphite discharge pipe.

Samples of the slag and the desulphurized cast iron were taken for chemical analysis.

From case to case scrap cast iron was added again after discharge and the test repeated one or more times. The cast iron used for the tests contained 0.21% by weight sulphur (S), 3.17% by weight carbon (C), 2.06% by weight silicon (Si) and 0.27% by weight manganese (Mn).

The test results are summarized in the table appearing in FIG. 2. In addition to the sulphur contents of the slags found by analyses (S found), the calculated sulphur contents of the slags (S calculated) are stated. The calculated sulphur contents of the slags result from the initial content of the particular slags, i.e. from the sulphur content found in the previous experiment plus the calculated increase in the sulphur content from desulphurization of the cast iron during the experiment.

Example 1

After the slag was melted down and a slag temperature of 1650° C. reached, cast iron with 0.21% S was melted down (Sample no. 0). After the cast iron was melted down the slag temperature was held at 1650° C. for one half hour.

At the end of the half-hour experimental period the cast iron and slag were stirred for five minutes with a graphite rod. The cast iron was then tapped and samples of slag and cast iron taken.

Sample no. 0 states the S content of the cast iron used.

The sulphur values of the desulphurized cast iron were between 0.010 and 0.017% by weight (Sample nos. 1–3). The calculated sulphur losses of the slags were 0.38% by weight in each case based on the test duration of one half hour.

At the end of the desulphurization experiments 40% manganese ore—based on the slag weight—was added to the slag and the slag thereby desulphurized (Sample no. 4).

Then 7% lignite coke was fed onto the slag and the manganese or iron oxide largely reduced from the slag (Sample no. 5).

Example 2

In this experiment compressed air was blown into the slag by means of a lance. The sulphur contents of the desulphurized cast iron were between 0.001 and 0.008% by weight (Samples no. 1–4). The calculated sulphur losses of the slags varied between 0.31 and 0.59% by weight (Samples no. 2–4) based on the test duration of one half hour.

The slag temperature was 1520° C.

At the end of the desulphurization experiments the S content of the slag was reduced to 0.13% by weight by adding 40% manganese ore (Sample no. 5).

Example 3

In Example 3 compressed air and water vapor was blown into the slag by means of a lance. The sulphur contents of the desulphurized cast iron were between 0.002 and 0.003% by weight (Samples no. 1–3). The calculated S losses of the slags varied between 0.49 and 0.56% by weight (Samples no. 2–3) based on the test duration of one half hour.

The slag temperature was 1530° C.

Example 4

In this experiment cast iron and slag was stirred with a graphite rod for five minutes at the end of the half-hour test duration.

The desulphurization effect of the slag, whose chemical analysis was outside the inventive composition, was unsatisfactory. The S contents of the cast iron after the desulphurization process were between 0.044 and 0.059% by weight (Samples no. 1–4).

The slag temperature was 1630° C.

Although certain preferred embodiments and methods have been disclosed herein, it will be apparent from the foregoing disclosure to those skilled in the art that variations and modifications of such embodiments and methods may be made without departing from the true spirit and scope of the invention. Accordingly, it is intended that the invention shall be limited only to the extent required by the appended claims and the rules and principles of applicable law.

| | | SLAG | | | | | | | | | | | | |
|---|---|---|---|---|---|---|---|---|---|---|---|---|---|---|
| Example | Sample | | | | | | | | | S | Nominal S | Δ S | IRON | |
| No. | No. | $SiO_2$ | $Al_2O_3$ | $TiO_2$ | FeO | MnO | CaO | MgO | $CaF_2$ | Found | Calculated | Calculated | S | ΔS Found |
| 1 | 0 | | | | | | | | | | | | 0.210 | |
| | 1 | | | | | | | | | 5.93 | — | — | 0.107 | −0.193 |
| | 2 | 13.52 | 17.21 | <0.10 | <0.10 | <0.10 | 45.10 | 4.63 | 16.16 | 5.65 | 6.03 | −0.38 | 0.013 | −0.197 |
| | 3 | | | | | | | | | 5.37 | 5.75 | −0.38 | 0.010 | −0.200 |
| | 4 | | | | 1.32 | 2.23 | | | | 0.08 | | | | |
| | 5 | | | | 0.29 | 0.16 | | | | 0.12 | | | | |
| 2 | 0 | | | | | | | | | | | | 0.210 | |
| | 1 | | | | | | | | | 6.47 | — | — | 0.008 | −0.202 |
| | 2 | | | | | | | | | 6.26 | 6.57 | −0.31 | 0.001 | −0.209 |
| | 3 | 12.87 | 15.27 | <0.10 | 0.12 | <0.10 | 52.53 | 2.55 | 12.65 | 6.03 | 6.36 | −0.33 | 0.001 | −0.209 |
| | 4 | | | | | | | | | 5.54 | 6.13 | −0.59 | 0.001 | −0.209 |
| | 5 | | | | | | | | | 0.13 | | | | |
| 3 | 0 | | | | | | | | | | | | 0.210 | |
| | 1 | 15.61 | 21.22 | 0.07 | 0.08 | <0.10 | 52.21 | 4.28 | 5.58 | 7.08 | — | | 0.003 | −0.207 |
| | 2 | | | | | | | | | 6.62 | 7.18 | −0.56 | 0.002 | −0.208 |
| | 3 | | | | | | | | | 6.23 | 6.72 | −0.49 | 0.002 | −0.208 |
| 4 | 0 | | | | | | | | | | | | 0.210 | |
| | 1 | | | | | | | | | 8.32 | — | | 0.044 | −0.166 |
| | 2 | 6.10 | 0.50 | <0.10 | 0.028 | 0.30 | 20.95 | 0.60 | 67.10 | 8.10 | 8.40 | −0.30 | 0.059 | −0.151 |
| | 3 | | | | | | | | | 7.95 | 8.18 | −0.23 | 0.046 | −0.164 |
| | 4 | | | | | | | | | 7.76 | 8.03 | −0.27 | 0.053 | −0.157 |

Stated in % by weight.

I claim:

1. A method for desulphurizing sulphur-containing iron comprising: melting and heating to a temperature of 1400° to 1800° C. a desulphurization slag comprising a composition by weight of no more than 20% $SiO_2$, no more than 30% $Al_2O_3$, about 5–40% $SiO_2$, $Al_2O_3$, and $TiO_2$ combined, no more than 2% FeO, no more than 1.5% MnO, about 25–65% CaO, MgO, BaO, $Na_2O$, and $K_2O$ combined, no more than 20% MgO, no more than 10% $Na_2O$ and $K_2O$ combined, no more than 60% $CaF_2$, and about 50–85% CaO, MgO, BaO, $Na_2O$, $K_2O$ and $CaF_2$ combined, said slag having a ratio of CaO and MgO to $SiO_2$ and ½$Al_2O_3$ of at least 2 and having a ratio of $Na_2O$ and $K_2O$ to $SiO_2$ of no more than 1;

adding said iron to said slag in an amount sufficient to maintain a ratio of not more than 10 parts by weight of iron to desulphurization slag;

mixing said sulphur-containing iron with said molten slag to desulphurize said sulphur-containing iron;

discharging said desulphurized iron from beneath said slag.

2. The method of claim 1 wherein the desulphurization slag comprises a composition by weight of no more than 15% $SiO_2$, no more than 30% $Al_2O_3$, about 20–40% $SiO_2$, $Al_2O_3$, and $TiO_2$ combined, no more than 1.2% FeO, no more than 0.7% MnO, about 30–65% CaO+MgO combined, no more than 15% MgO, about 2–50% $CaF_2$, about 55–80% CaO+MgO+$CaF_2$ combined, and no more than 1% $Na_2O$ and $K_2O$ combined.

3. The method of claim 1 wherein said slag is composed essentially of a composition by weight of about 5–15% $SiO_2$, no more than 25% $Al_2O_3$, about 25–40% $SiO_2$, $Al_2O_3$, and $TiO_2$ combined, no more than 5% $TiO_2$, no more than 0.7% FeO, no more than 0.5% MnO, 50–65% CaO+MgO, no more than 5% MgO, about 7–30% $CaF_2$, about 55– 75% CaO+MgO+$CaF_2$, combined, and no more than 0.5% $Na_2O$ and $K_2O$ combined.

4. The method of claim 1 wherein the temperature of the desulphurization slag is between 1500° and 1700° C.

5. The method of claim 1 further wherein said mixing is accomplished by injecting a gas into a mixture of said sulphur-containing iron and said molten slag by said mixture.

6. The method of claim 5 wherein the injecting of said gas is by means of a lance placed into the molten slag from above.

7. The method of claim 5 wherein the injecting of said gas is by means of a tuyere.

8. The method of claim 1, further including removal of the sulphur from the desulphurization slag by injecting into the slag a material chosen from the group composed of air, oxygen, water, iron oxide, iron ore and manganese.

9. The method of claim 8 wherein sulphur is removed from said desulphurization slag continuously.

10. The method of claim 8 wherein said sulphur is removed from said desulphurization slag intermittently.

11. The method of claim 1 wherein the ratio of molten iron to slag is a maximum of 5:1 parts by weight.

12. The method of claim 1 wherein the ratio of molten iron to slag is a maximum of 2.5:1 parts by weight.

* * * * *